US007014719B2

(12) United States Patent
Suzuki et al.

(10) Patent No.: US 7,014,719 B2
(45) Date of Patent: Mar. 21, 2006

(54) AUSTENITIC STAINLESS STEEL EXCELLENT IN FINE BLANKABILITY

(75) Inventors: Satoshi Suzuki, Shin-Nanyo (JP); Takashi Igawa, Shin-Nanyo (JP); Hiroshi Fujimoto, Shin-Nanyo (JP); Naoto Hiramatsu, Shin-Nanyo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 10/227,598

(22) Filed: Aug. 23, 2002

(65) Prior Publication Data

US 2003/0099567 A1 May 29, 2003

Related U.S. Application Data

(63) Continuation-in-part of application No. 09/855,736, filed on May 15, 2001, now abandoned.

(51) Int. Cl.
*C22C 38/00* (2006.01)

(52) U.S. Cl. ..... 148/325; 148/326; 148/327

(58) Field of Classification Search ..... 148/325, 148/326, 327; 420/43–46

See application file for complete search history.

(56) References Cited

FOREIGN PATENT DOCUMENTS

| | | | |
|---|---|---|---|
| JP | (1996) 08-109447 A2 | | 4/1996 |
| JP | 08109447 | * | 4/1996 |
| JP | (1996) 08-260111 A2 | | 10/1996 |
| JP | 08260111 | * | 10/1996 |
| KR | 9507792 A | | 7/1995 |

* cited by examiner

*Primary Examiner*—Sikyin Ip
(74) *Attorney, Agent, or Firm*—The Webb Law Firm

(57) ABSTRACT

An austenitic stainless steel comprising (C+½N) up to 0.060 mass %, Si up to 1.0 mass %, Mn up to 5 mass %, S up to 0.003 mass %, S/Mn ratio up to 0.003, 15–20 mass % Cr, 5–12 mass % Ni, Cu up to 5 mass %, 0–3.0 mass % Mo and the balance being Fe except inevitable impurities under the condition that a value $Md_{30}$ (representing a ratio of a strain-induced martensite) defined by the under-mentioned formula is controlled within a range of −60 to −10. Hardness increase of the steel sheet after being cold-rolled is preferably 20% or more as Vickers hardness. A metallurgical structure of the steel sheet is preferably adjusted to grain size number of #8 to #11 in a finish annealed state. The steel sheet is blanked with high dimensional accuracy, and a die life is also prolonged.

$$Md_{30}=551-462(C+N)-9.2Si-29(Ni+Cu)-8.1Mn-13.7Cr-18.5Mo.$$

4 Claims, 5 Drawing Sheets

AUSTENITIC STAINLESS STEEL EXCELLENT IN FINE BLANKABILITY

CROSS-REFERENCE TO RELATED APPLICATION

This application is a continuation-in-part and claims the benefit of U.S. patent application Ser. No. 09/855,736, filed May 15, 2001, now abandoned entitled "Austenitic Stainless Steel Excellent in Fine Blankability," which is hereby incorporated by reference in its entirety.

BACKGROUND OF THE INVENTION

1. Field of the Invention

The present invention relates to an austenitic stainless steel excellent in blankability, especially fine blankability.

2. Description of Related Art

Shear process, especially blanking, with a press has been applied to various kinds of metal sheets such as common steel, stainless steel and nonferrous metal, since the metal sheets can be efficiently sized to an objective shape. However, a plane formed by blanking is rugged with poor dimensional accuracy; a metal sheet is likely to be drooped at its broader surface, and thickness of the metal sheet is reduced at a part near the blanking plane.

A blanking plane, which is generated by blanking a metal sheet, comprises a shear plane and a fracture plane. The shear plane has a smooth surface, while the fracture plane worsens dimensional accuracy of a blanked product. A shear plane ratio is calculated by dividing a surface area of the shear plane by a total surface area of the shear and fracture planes.

When blanking is adopted to a process for manufacturing a product which needs high dimensional accuracy, a blanking plane is ground by post-treatment such as barrel finishing. Such post-treatment is basically an extra process and causes poor productivity. In this regard, a fine blanking method has been adopted for manufacturing a product with high dimensional accuracy. In the fine blanking method, clearance is determined at a very small value to suppress formation of a fracture plane, and inflow of metal is suppressed to reduce generation of drooping during blanking.

On the other hand, stainless steel has been used so far for use exposed to a corrosive or high-temperature atmosphere. Especially, SUS 304 is representative stainless steel suitable for such use.

SUS 304 austenitic stainless steel is a hard material, causing the life of fine blanking dies to be shortened. The hardness of SUS 304 austenitic stainless steel also causes an increase of a ratio of a fracture plane, which degrades quality of a blanking plane, as well as increase of drooping. Even if a shear plane is formed with high dimensional accuracy by blanking, a working cost is higher compared with a cost for blanking common steel. Accounting these disadvantages, SUS 304 austenitic stainless steel is blanked by a usual method and then ground for manufacturing a product which shall have a blanking plane with high dimensional accuracy.

SUMMARY OF THE INVENTION

The present invention provides an austenitic stainless steel, in which softening and stability of an austenite phase are controlled so as to increase a ratio of a shear plane, especially suitable for fine blanking.

The present invention proposes a new austenitic stainless steel having compositions comprising (C+½N) up to 0.060 mass %, Si up to 1.0 mass %, Mn up to 5 mass %, S up to 0.003 mass %, S/Mn ratio up to 0.003, 15–20 mass % Cr, 5–12 mass % Ni, Cu up to 5 mass %, 0–3.0 mass % Mo and the balance being essentially Fe. A value $Md_{30}$, which represents a ratio of a strain-induced martensite phase, defined by the below-mentioned formula is adjusted within a range of −60 to −10.

$$Md_{30}=551-462(C+N)-9.2Si-29(Ni+Cu)-8.1Mn-13.7Cr-18.5Mo$$

The austenitic stainless steel is manufactured by a conventional process involving hot-rolling, annealing, pickling, cold-rolling and finish annealing. A ratio of hardness increase in a cold-rolled state is preferably controlled at a value of 20% or more as Vickers hardness. The stainless steel in the finished annealed state is preferably conditioned to a metallurgical structure of grain size number (regulated in JIS G0551) within a range of 8–11.

DESCRIPTION OF THE PREFERRED EMBODIMENTS

Figure 1:
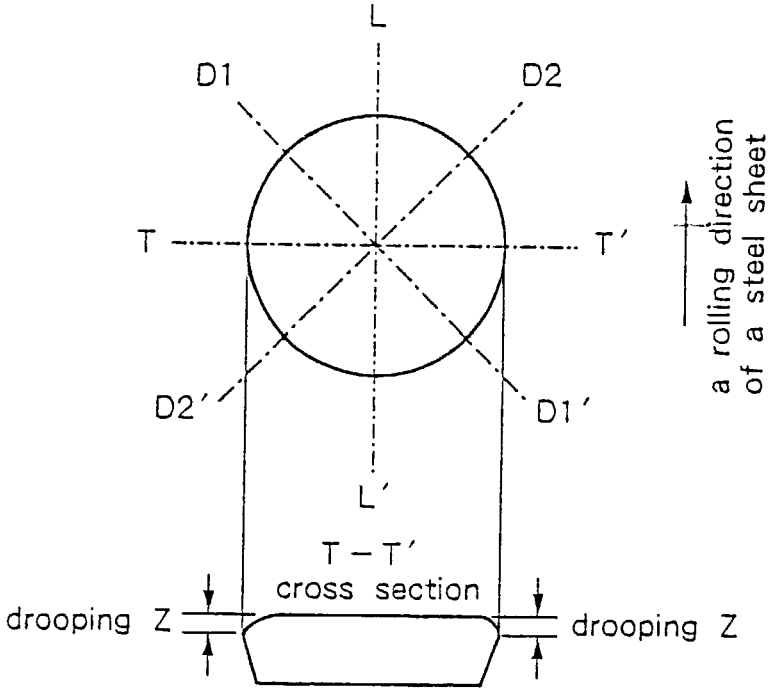
FIG. 1 is a schematic view for explaining generation of drooping in a blanked piece and positions for detection of drooped parts.

The inventors have researched various aspects of the relationship of material properties of austenitic stainless steel with a state of a blanking plane formed by fine blanking, and discovered that a ratio of a strain-induced martensite (α' phase) puts a significant influence on a ratio of a shear plane to a blanking plane.

The strain-induced martensite (α' phase) is harder and inferior of ductility, compared with an austenitic (γ phase) matrix. Excessive generation of the strain-induced martensite (α' phase) means degradation of ductility, early occurrence of fracture due to an increase of crack-initiating points on a blanking plane and a decrease of a ratio of shear plane. If generation of the strain-induced martensite (α' phase) is too little, on the contrary, the austenitic stainless steel is blanked as such in the γ phase inferior of ductility, resulting in early occurrence of fracture at a blanking plane due to a poor distribution of strains and a decrease of a ratio of shear plane. A ratio of α' phase is preferably controlled within a range of 1–30%, preferably 10–20% under conventional fine blanking conditions, in order to realize 100% shear plane ratio. Additionally, the value $Md_{30}$ is determined within a range of from −60 to −10 to generate α' phase with a proper ratio suitable for realization of 100% shear plane ratio. PARA0Softness of the austenitic stainless steel is well balanced with the effect of the strain-induced martensite (α' phase) on the quality of the fracture plane, so as to suppress occurrence of drooping. Thus, a blanking plane is improved in dimensional accuracy and die life is prolonged. PARA0The proposed austenitic stainless steel contains various alloying components at predetermined ratios as follows:

(C+½N) Up to 0.060 Mass % PARA0C and N are components effective for adjusting stability of an austenite phase. However, excessive addition of C and N makes the austenite phase harder due to solution-hardening, and also makes a strain-induced martensite phase harder. The hardening causes increase of blanking load and short life of dies. Therefore, a ratio of (C+½N) is controlled at 0.060 mass % or less.

Si Up to 1.0 Mass % PARA0Si is an alloying component added as a deoxidizing agent at a steel refining step. Excessive addition of Si makes an austenite phase harder due to solution-hardening, and degrades blankability of the stainless steel. In this regard, an upper limit of Si content is determined at 1.0 mass %.

Mn Up to 5 Mass % PARA0Mn is an alloying component effective for stabilizing the austenite phase and improving blankability of the stainless steel. These effects become apparent with an increase of Mn content. But, excessive addition of Mn more than 5 mass % causes increase of nonmetallic inclusions which put harmful influences on corrosion resistance and workability.

S Up to 0.003 Mass % PARA0A ratio of a shear plane to a blanking plane is reduced with an increase of S content. The element S also puts harmful influences on corrosion resistance, which is the most important property of stainless steel. In this regard, an upper limit of S content is determined at 0.003 mass %. Especially, for such a product, which shall have a blanking plane with high dimensional accuracy, S content is preferably controlled to 0.003 mass % or less so as to increase a ratio of a shear plane.

S/Mn Up to 0.003 PARA0S content shall also be controlled in relation with Mn content, in order to increase a ratio of a shear plane formed by fine blanking. The shear plane ratio is greatly influenced by nonmetallic inclusions, especially MnS. The shear plane ratio becomes higher with a decrease of MnS. A cut plane can be formed to an ideal plane, i.e., a shear plane ratio being 100%, by controlling an S/Mn ratio not more than 0.003 in addition to reduction of S content below 0.003 mass %.

Cr: 15–20 Mass % PARA0Cr content of 15 mass % or more is necessary to ensure corrosion resistance of stainless steel. But, excessive addition of Cr of more than 20 mass % makes the stainless steel harder and put harmful effects on die life.

Ni: 5–12 Mass % PARA0Ni is an alloying element for stabilizing the austenite phase. Such an effect is realized by the addition of Ni at a ratio of 5 mass % or more. Blankability of the stainless steel is also improved with an increase of Ni content. However, Ni is an expensive element and raises steel cost, so that an upper limit of Ni content is determined at 12 mass %.

Cu Up to 5 Mass % PARA0Cu is an alloying element effective for improvement of blankability and also stabilization of the austenite phase. However, excessive addition of Cu more than 5 mass % puts harmful influences on hot workability.

Mo: 0–3.0 Mass % PARA0Mo is an optional alloying element effective for improvement of corrosion resistance, but excessive addition of Mo more than 3.0 mass % makes the stainless steel too hard, resulting in degradation of fine blankability.

A Value $Md_{30}$ (Representing a Ratio of a Strain-Induced Martensite): −60 to −10 PARA0An effect of a strain-induced martensite (α' phase) on a ratio of a shear plane to a blanking plane is a result discovered by the inventors from various experiments. A ratio of the strain-induced martensite (α' phase) can be calculated from components and contents of an austenitic stainless steel. In the case where the austenitic stainless steel is designed to the composition having the value $Md_{30}$ controlled within a range of −60 to −10, a ratio of a shear plane is higher as explained in under-mentioned Examples, and a blanking plane is formed with high dimensional accuracy.

A Ratio of Hardness Increase of an Austenitic Stainless Steel:

20% or more by Vickers hardness PARA0A cold-rolled austenitic stainless steel sheet is harder due to introduction of many transpositions during cold rolling, compared with an annealed sheet which involves less transpositions. When a degree of hardening caused by cold-rolling is adjusted at a ratio of 20% or more by Vickers hardness, metal flow toward a lower part of a blank is suppressed, resulting in reduction of drooping. PARA0The ratio of hardness increase is defined by the formula of {(Vickers hardness of a cold-rolled steel sheet)−(Vickers hardness of an annealed steel sheet)}/(Vickers hardness of an annealed steel sheet)×100 (%) in this specification. The ratio of hardness increase of 20% or more is necessary to suppress occurrence of drooping caused by blanking to a half or less of drooping which is generated by blanking an as-annealed steel sheet. However, an extremely hardened steel sheet causes increase of shear resistance during blanking and promotes abrasion of dies. In this regard, an upper limit of the ratio of hardness increase is preferably determined at 150%, taking into account the effect on reduction of drooping in balance with die life.

Grain Size Number: #8 to #11 PARA0As crystal grains are coarsened, the stainless steel is softer, and a ratio of a shear plane to a blanking plane is higher, but the blanked steel sheet is heavily drooped. In this regard, coarse crystal grains are unfavorable for manufacturing a product which shall have dimensional accuracy at its blanking plane as well as smoothness. On the other hand,

TABLE 1

AUSTENITIC STAINLESS STEELS USED IN EXAMPLE 1

| Sample | Alloying Components (mass %) | | | | | | | | | | | |
|---|---|---|---|---|---|---|---|---|---|---|---|---|
| No. | C | Si | Mn | Ni | Cr | S | Cu | Mo | N | $Md_{30}$ | S/Mn | Note |
| 1 | 0.01 | 0.5 | 1.0 | 10.75 | 18.25 | 0.001 | 0.10 | 0.08 | 0.01 | −37.1 | 0.001 | Inventive |
| 2 | 0.02 | 0.6 | 1.2 | 8.21 | 18.70 | 0.003 | 2.10 | 0.07 | 0.03 | −43.8 | 0.003 | Examples |
| 3 | 0.03 | 0.5 | 1.0 | 8.32 | 18.10 | 0.002 | 1.92 | 0.07 | 0.03 | −35.6 | 0.002 | |
| 4 | 0.04 | 0.4 | 1.0 | 10.23 | 17.16 | 0.001 | 0.10 | 0.06 | 0.05 | −38.1 | 0.001 | Comparative |
| 5 | 0.02 | 0.3 | 1.7 | 8.01 | 17.10 | 0.001 | 3.21 | 0.07 | 0.01 | −40.3 | 0.001 | Inventive |
| 6 | 0.01 | 0.4 | 1.0 | 10.01 | 18.26 | 0.002 | 0.08 | 0.08 | 0.01 | −14.3 | 0.002 | Examples |
| 7 | 0.02 | 0.5 | 0.8 | 11.15 | 18.42 | 0.002 | 0.08 | 0.05 | 0.02 | −57.5 | 0.003 | |
| 8 | 0.01 | 0.4 | 1.2 | 11.20 | 19.10 | 0.001 | 0.10 | 0.08 | 0.01 | −62.5 | 0.001 | Comparative |
| 9 | 0.02 | 0.6 | 0.5 | 11.82 | 18.33 | 0.001 | 0.10 | 0.08 | 0.02 | −75.3 | 0.002 | Examples |
| 10 | 0.01 | 0.5 | 0.7 | 9.83 | 18.25 | 0.001 | 0.10 | 0.08 | 0.01 | −8.0 | 0.001 | |
| 11 | 0.03 | 0.6 | 0.7 | 8.21 | 18.25 | 0.001 | 0.10 | 0.08 | 0.04 | 15.0 | 0.001 | |
| 12 | 0.05 | 0.5 | 0.8 | 8.81 | 18.25 | 0.001 | 0.81 | 0.08 | 0.02 | −22.9 | 0.001 | Inventive Examples |
| 13 | 0.03 | 0.6 | 1.0 | 10.27 | 18.91 | 0.004 | 0.10 | 0.09 | 0.02 | −47.2 | 0.004 | Comparative |
| 14 | 0.02 | 0.6 | 1.0 | 9.89 | 19.10 | 0.006 | 0.10 | 0.07 | 0.02 | −33.8 | 0.006 | Examples |
| 15 | 0.01 | 0.4 | 0.8 | 10.27 | 18.91 | 0.007 | 0.08 | 0.09 | 0.02 | −33.9 | 0.009 | |
| 16 | 0.03 | 0.6 | 0.6 | 9.21 | 19.10 | 0.009 | 0.08 | 0.09 | 0.02 | −15.2 | 0.015 | |

the proposed austenitic stainless steel is conditioned to a metallurgical structure composed of minimized grains at a grain size number within a range of #8 to #11 in a finished annealed state. Said grain size number is bigger, compared with an ordinary grain size number of #6 to #8. The minimized grains are realized by reduction of an input energy, e.g., annealing the stainless steel at a relatively lower temperature or in a relatively short time. Due to such conditioning of grain sizes, occurrence of drooping is suppressed while a ratio of a shear plane is kept at the same level.

EXAMPLE 1

Various stainless steels having compositions shown in Table 1 were melted, cast, soaked at 1230° C., and hot-rolled to a thickness of 10 mm. Thereafter, the hot-rolled steel sheet was annealed 1 minute at 1150° C., pickled with an acid, cold-rolled to thickness of 5 mm, annealed 1 minute at 1050° C. and pickled again with an acid.

Each annealed steel sheet was examined by the below-described blanking test to research shear resistance, a ratio of a shear plane to a blanking plane and a ratio of droop to thickness, and its Vickers hardness was measured as Rockwell B hardness regulated at JIS Z2240.

A test piece cut off each annealed steel sheet was blanked to a disc shape with clearance of O. 1 mm or 0.25 mm (a clearance ratio calculated as clearance/thickness of a test piece is 2% or 5%, respectively) at a blanking speed of 600 mm/minute, using a punch of 50 mm in outer diameter and a die of 50.2 mm or 50.5 mm in inner diameter.

Each disc (a blanked piece) was measured with a laser-type noncontacting position sensor at 8 points, i.e., every 2 points along a rolling direction, a crosswise direction and a direction inclined with 45 degrees with respect to the rolling direction as shown in FIG. 1, to detect a degree of droop Z at each point. The measured values were averaged, and a ratio of droop to thickness was calculated as a ratio of the mean value to thickness of the test piece.

Figure 2:
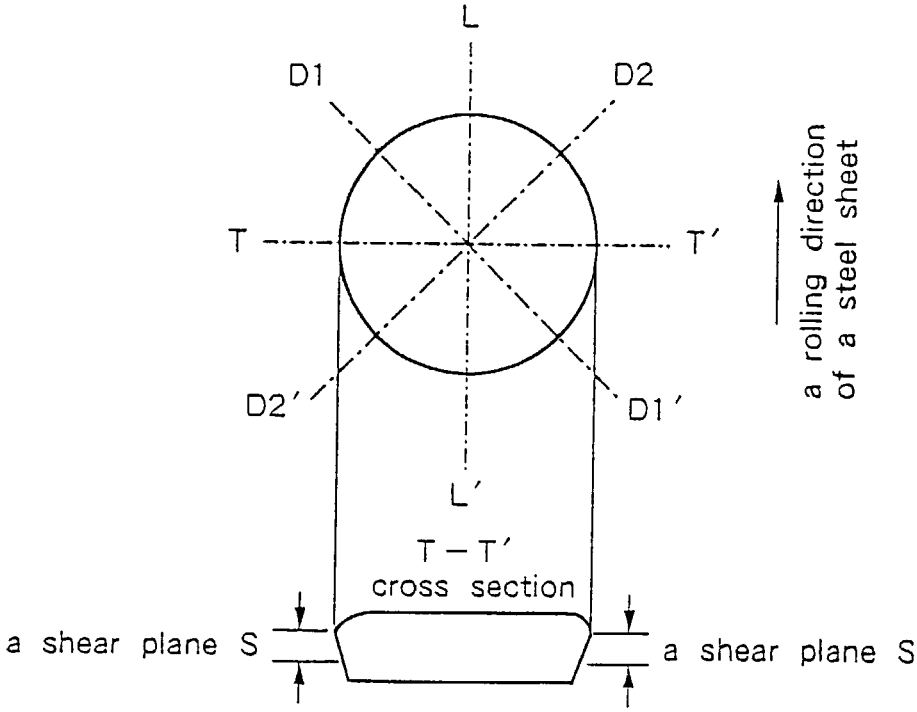
FIG. 2 is a schematic view for explaining formation of a shear plane at a blanking plane of a product and positions for measuring the shear plane.

Thickness of a shear plane S of each disc (a blanked piece) was also measured at 8 points, i.e., every 2 points along a rolling direction, a crosswise direction and a direction inclined 45 degrees with respect to the rolling direction, as shown in FIG. 2. The measured values were averaged, and a ratio of a shear plane was calculated as a ratio of the mean value to thickness of the test piece.

Figure 3:
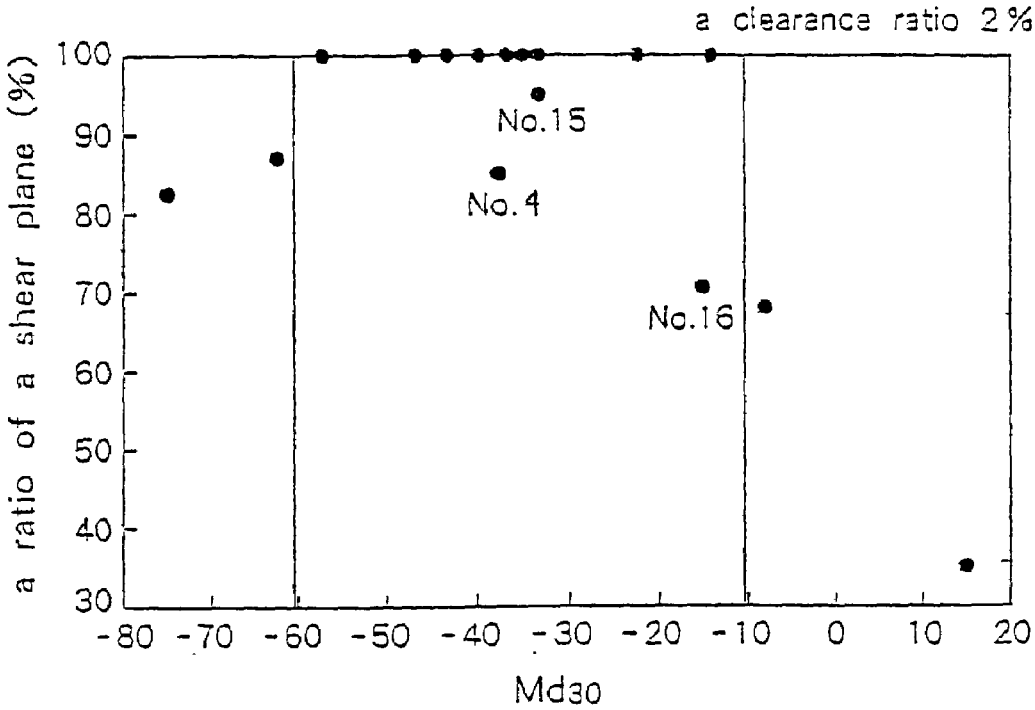
FIG. 3 is a graph showing a relationship of $Md_{30}$ value with a ratio of a shear plane.

The ratio of a shear plane formed by blanking each test piece with a clearance ratio of 2% was researched in relationship with a value $Md_{30}$ of each test piece. Results are shown in FIG. 3. It is noted that a blanking plane with a ratio of a shear plane being 100% was gained at a $Md_{30}$ value within a range of −60 to −10. Although Sample Nos. 4, 15 and 16 had $Md_{30}$ values within a range of −60 to −10, their blanking planes were exceptionally poor with ratios of a shear plane being 85%, 95% and 71%, respectively.

Figure 4:
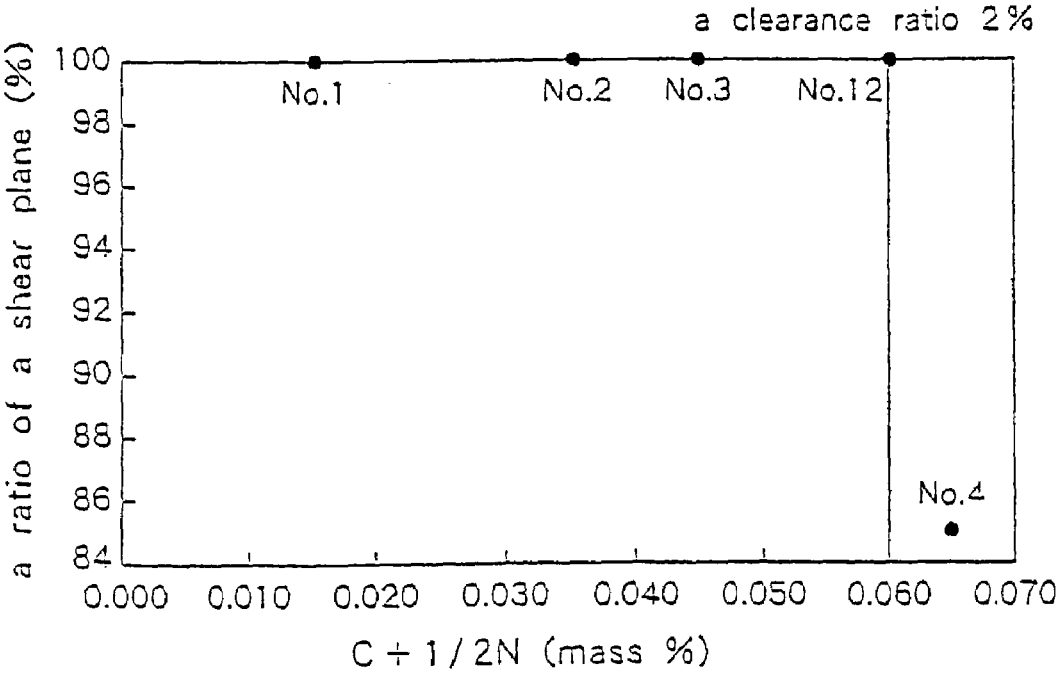
FIG. 4 is a graph showing a relationship of (C+½N) with a ratio of a shear plane.

A relationship of (C+½N) with a ratio of shear plane was researched, as for Sample Nos. 1–4 and 12 each having value $Md_{30}$ within a range of −60 to −10. Results are shown in FIG. 4. It is noted that Sample Nos. 1–3 and 12 each containing (C+½N) no more than 0.06 mass % were blanked with a ratio of a shear plane being 100%. On the other hand, Sample No. 4 containing (C+½N) more than 0.06 mass % was blanked with a ratio of a shear plane of 85%.

Figure 5:
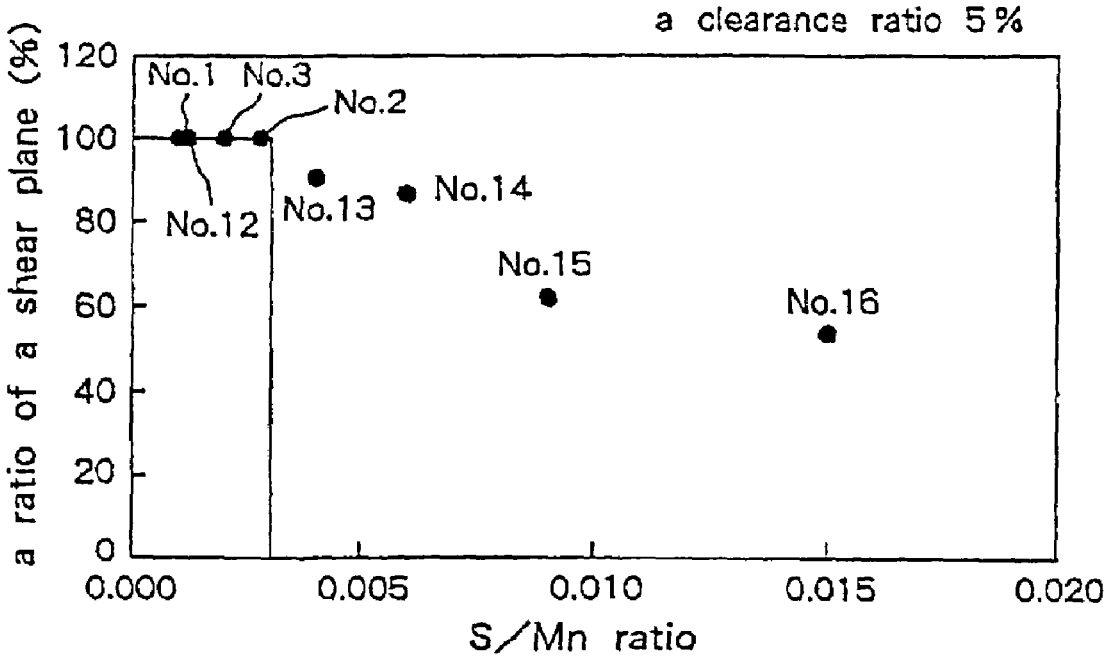
FIG. 5 is a graph showing a relationship of S/Mn ratio with a ratio of a shear plane at a clearance ratio of 5%.

The relationship of the S/Mn ratio with a ratio of a shear plane is shown in FIG. 5. Sample Nos. 1–3 and 12–16 having values of $Md_{30}$ within a range of −60 to −10 and containing (C+½N) up to 0.06 mass % were blanked with a clearance ratio of 5%. It is noted that Sample Nos. 1–3 and 12 with an S/Mn ratio of not more than 0.003 were blanked with a ratio of a shear plane being 100%. The ratio of a shear plane was reduced as seen in Sample Nos. 13 and 14 when having an S/Mn ratio of 0.004 and 0.006, respectively.

TABLE 2

AUSTENITIC STAINLESS STEELS USED IN EXAMPLE 2

| Steel | alloying components (mass %) | | | | | | | | | | |
|---|---|---|---|---|---|---|---|---|---|---|---|
| Kind | C | Si | Mn | Ni | Cr | S | Cu | Mo | N | $Md_{30}$ | NOTE |
| A | 0.01 | 0.5 | 0.8 | 10.43 | 18.40 | 0.001 | 0.09 | 0.07 | 0.01 | −27.8 | an inventive example |
| B | 0.06 | 0.6 | 0.6 | 8.02 | 18.21 | 0.003 | 0.08 | 0.08 | 0.04 | 8.6 | a comparative example |

Additionally, Sample Nos. 15 and 16 with an S/Mn ratio of 0.009% and 0.015%, showed a larger reduction in the ratio of a shear plane. The results prove that controlling S content to less than 0.003 mass % and the S/Mn ratio at not more than 0.003, is effective for blanking the steel sheet.

EXAMPLE 2

Stainless steels having compositions shown in Table 2 were melted, cast, hot-rolled to a thickness of 10 mm at an initial temperature of 1230° C. Thereafter, each hot-rolled steel sheet was annealed 1 minute at 1150° C., pickled with an acid, cold-rolled to an intermediate thickness of 5–8 mm, annealed 1 minute at 1050° C., and pickled again with an acid. Some of the steel sheets were provided as annealed steel sheets (A1, B1) of 5 mm in thickness. The other annealed steel sheets of intermediate thickness were further cold-rolled to a thickness of 5 mm and provided as temper-rolled steel sheets (A2–A6, B2, B3).

Figure 6:
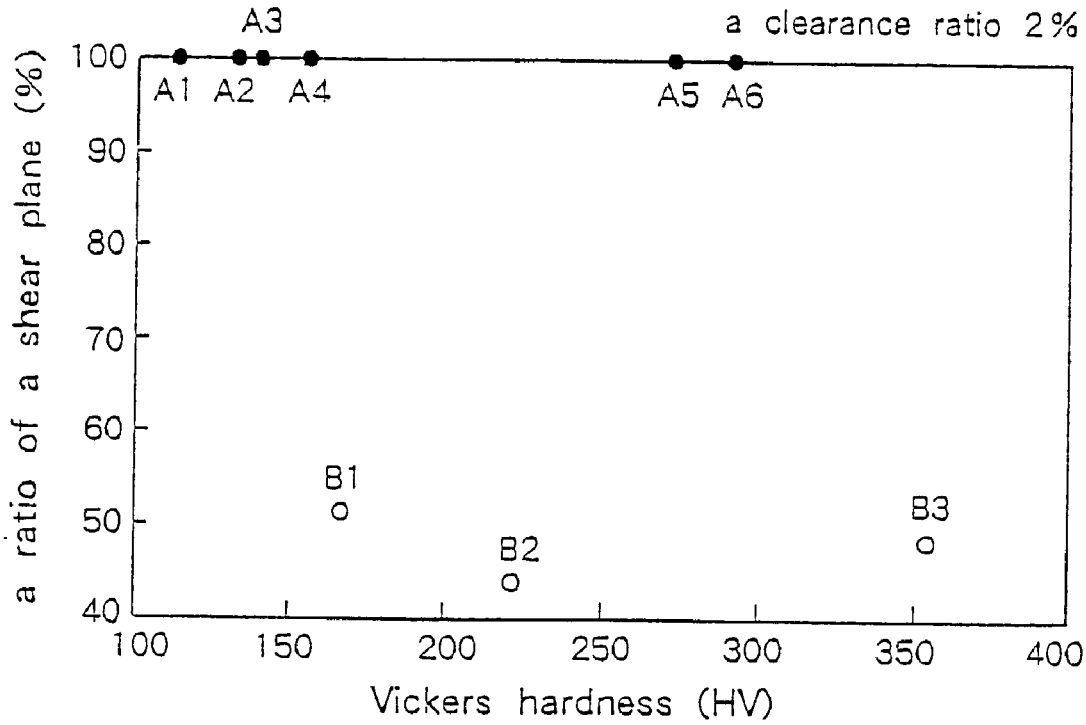
FIG. 6 is a graph showing a relationship of Vickers hardness with a ratio of a shear plane.

A test piece was cut off each of the annealed and temper-rolled steel sheets, and blanked with a clearance ratio of 2% under the same conditions as in Example 1. FIG. 6 shows a relationship of Vickers hardness of each test piece with a ratio of a shear plane. It is noted that any of annealed or temper-rolled Sample Nos. A1 to A6 were blanked with a ratio of a shear plane being 100%. On the other hand, Sample Nos. B1 to B3 corresponding to SUS 304 were blanked with low ratios of a shear plane near 45%.

Figure 7:
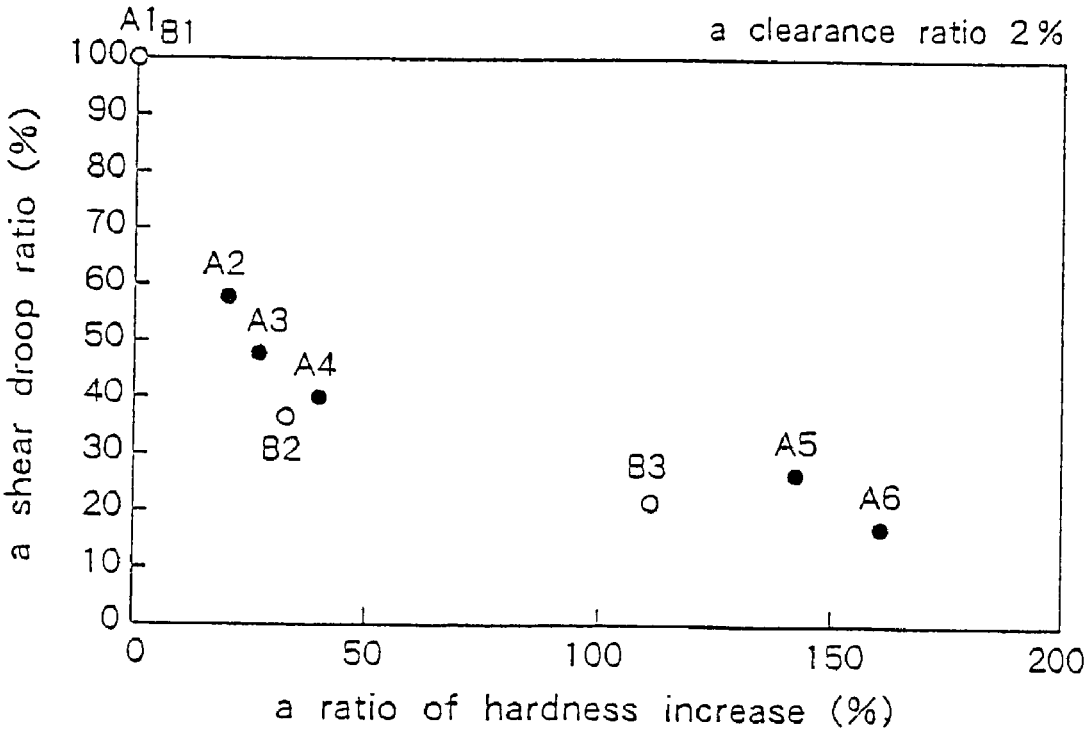
FIG. 7 is a graph showing a relationship of hardness increase caused by temper-rolling with a shear droop ratio.

A shear droop ratio was calculated as (a ratio of droop to thickness in a temper-rolled steel sheet)/(a ratio of droop to thickness in an annealed steel sheet), to research an effect of hardness increase by temper-rolling on generation of drooping. Results are shown in FIG. 7. It is noted that a shear droop ratio of any temper-rolled steel sheet A3 to A6 hardened by 20% or more as Vickers hardness was less than 50%, i.e., less than a half of droop generated in the annealed steel sheet A1. On the other hand, a shear droop ratio of the temper-rolled steel sheet A2 hardened at a ratio of hardness increase of less than 20% was

TABLE 3

EFFECTS OF MATERIAL PROPERTIES OF STEEL SHEETS ON DIE LIFE

| No. | blanking cycles until exchange of dies | evaluation | note |
|---|---|---|---|
| A1 | 302969 | ◎ | inventive examples |
| A2 | 323341 | ◎ | |
| A3 | 309629 | ◎ | |
| A4 | 314211 | ◎ | |
| A5 | 354824 | ◎ | |
| A6 | 248142 | ○ | |

TABLE 3-continued

EFFECTS OF MATERIAL PROPERTIES OF STEEL SHEETS ON DIE LIFE

| No. | blanking cycles until exchange of dies | evaluation | note |
|---|---|---|---|
| B1 | 103288 | X | comparative examples |
| B2 | 52783 | X | |
| B3 | 9879 | X | |

◎: the same or longer die life, compared with the steel sheet A1
○: die life inferior to the steel sheet A1 but superior to the steel sheet B1
X: remarkable abrasion of dies about 70% compared with the annealed steel sheet A1. The results prove that hardness increase of 20% or more is effective for sufficient reduction of drooping.

Each test piece was continually blanked until exchange of dies, to research an effect of material properties of the steel sheets on the life of dies. Die life was evaluated as blanking cycles until the exchange of dies. Results are shown in Table 3. It is noted that any steel sheet of type-A can be blanked with greater cycles until the exchange of dies, compared with the steel sheets of type-B. That is, type-A steel sheets are effective for the extension of die life. It is also noted from comparison of the type-A steel sheets with each other that excessive hardness increase unfavorably causes decrease of blanking cycles. For instance, the blanking cycles until the exchange of dies were somewhat reduced, as the steel sheet A6 hardened more than 150%.

EXAMPLE 3

Stainless steels C, D having compositions shown in Table 4 were melted cast and hot-rolled to a thickness of 10 mm at an initial temperature. Thereafter, each hot-rolled steel sheet was annealed 1 minute at 1150° C., pickled with an acid, cold-rolled to a thickness of 5 mm, annealed 1 minute at 800–1100° C., and then pickled again with an acid.

Figure 8:
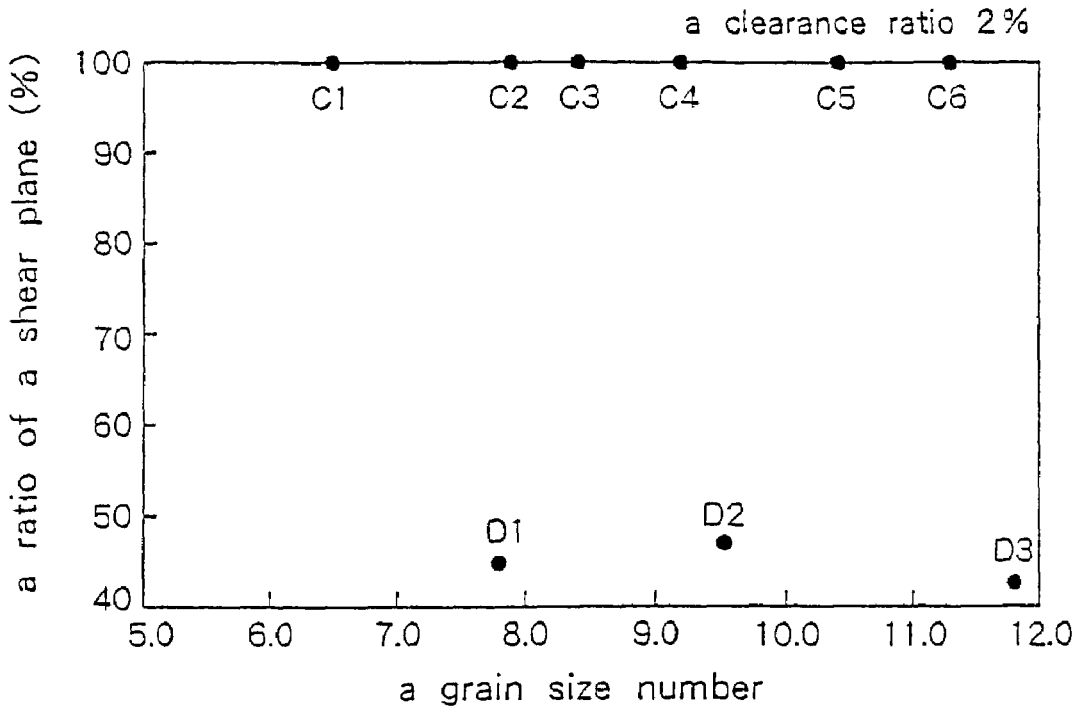
FIG. 8 is a graph showing a relationship of a grain size number with a ratio of a shear plane.

A test piece was cut off each steel sheet pickled after being annealed, and blanked with a clearance ratio of 2% under the same conditions as in Example 1. A ratio of a shear plane in the blanked test piece was calculated to research its relationship with the grain size number of the steel sheet. Results are shown in FIG. 8. It is noted that any of type-C steel sheets, according to the present invention, was blanked with a ratio of a shear plane being 100% regardless of its grain size number. On the other hand, any of type-D steel sheets, corresponding to SUS 304, was blanked with a lower ratio of a shear plane near 45%.

Figure 9:
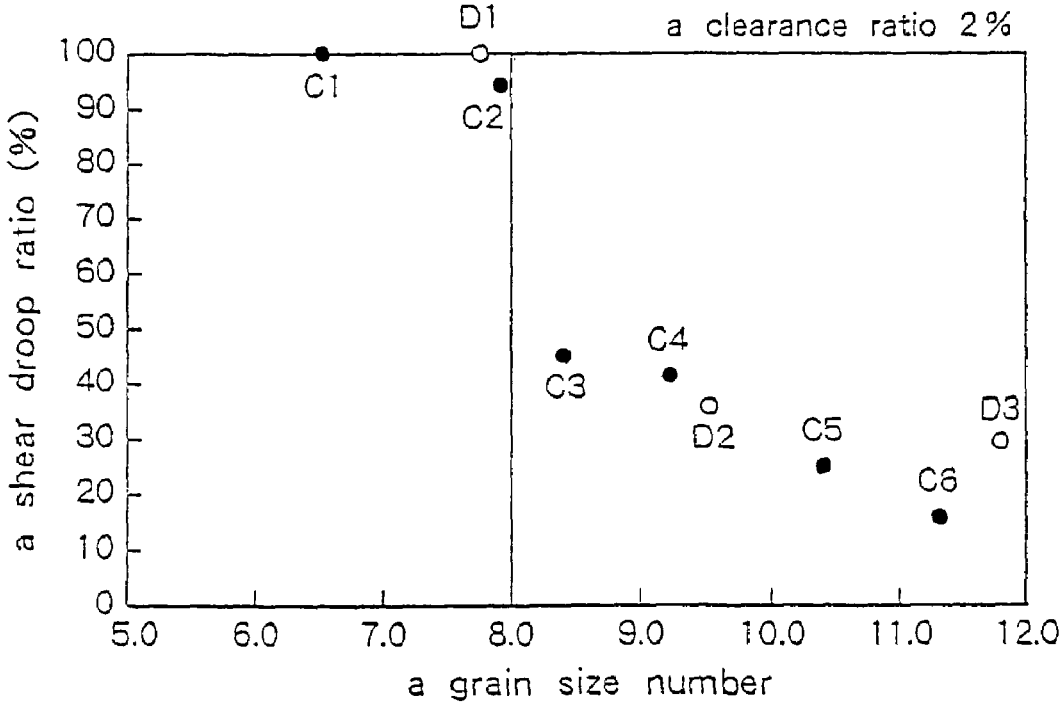
FIG. 9 is a graph showing a relationship of a grain size number with a shear droop ratio.

A relationship of a shear droop ratio with a grain size number is illustrated in FIG. 9. The relationship proves improvement of a shear droop ratio as the grain size number

TABLE 4

AUSTENITIC STAINLESS STEELS USED IN EXAMPLE 3

| Sample | Alloying components (mass %) | | | | | | | | | | |
|---|---|---|---|---|---|---|---|---|---|---|---|
| No. | C | Si | Mn | Ni | Cr | S | Cu | Mo | N | $Md_{30}$ | note |
| C | 0.02 | 0.6 | 0.7 | 10.21 | 18.71 | 0.002 | 0.08 | 0.05 | 0.02 | −34.3 | an inventive example |
| D | 0.06 | 0.6 | 0.6 | 8.02 | 18.21 | 0.003 | 0.08 | 0.08 | 0.04 | 8.6 | a comparative example |

TABLE 5

A RELATIONSHIP OF DIE LIFE WITH MATERAL PROPERTIES OF STEEL SHEETS

| No. | blanking cycles until exchange of dies | evaluation | note |
|---|---|---|---|
| C1 | 321962 | ◎ | inventive |
| C2 | 339672 | ◎ | examples |
| C3 | 321111 | ◎ | |
| C4 | 342632 | ◎ | |
| C5 | 315522 | ◎ | |
| C6 | 236981 | ○ | |
| D1 | 112011 | X | comparative |
| D2 | 49876 | X | examples |
| D3 | 5621 | X | |

◎: the same or longer die life, compared with the steel sheet A1
○: die life inferior to the steel sheet A1 but superior to the steel sheet B1
X: remarkable abrasion of dies is increased (i.e., minimized metallurgical structure) regardless of the kinds of steel sheets. As for type-C steel sheets according to the present invention, a shear droop ratio of any steel sheet C3 to C6 each having grain size number more than #8 is reduced to a half or less, compared with steel sheets C1, C2 of grain size number less than #8.

Each test piece was continually blanked until exchange of dies, to evaluate die life from blanking cycles. Results are shown in Table 5. It is noted that any steel sheet of type-C can be blanked with greater cycles until exchange of dies, i.e., suitable for elongation of die life compared with the steel sheets of type-D. But, blanking cycles were somewhat reduced as grain size number increased more than #11, as noted in a steel sheet C6. This result proves that excessive minimization of a metallurgical structure is unfavorable for die life.

An austenitic stainless steel proposed by the present invention can be blanked to a product with high dimensional accuracy, due to excellent blankability, especially fine blankability. Even when the steel sheet is blanked with a small clearance ratio, a ratio of a shear plane to a blanking plane can be kept at a higher level without occurrence of substantial drooping. The stainless steel sheet is also advantageous for elongation of die life, compared with conventional austenitic stainless steel sheets such as SUS 304. Consequently, blanked products with high dimensional accuracy are obtained from the proposed austenitic stainless steel sheet without increase of manufacturing cost.

The invention claimed is:

1. An austenitic stainless steel, which has an excellent property in fine blankability, consisting essentially of 0.010–0.050 mass % C, 0.010–0.030 mass % N, (C+½N) up to 0.060 mass %, Si up to 1.0 mass %, Mn up to 5 mass %, S up to 0.003 mass %, S/Mn ratio up to 0.003, 15–20 mass % Cr, 5–12 mass % Ni, Cu up to 5 mass %, optionally Mo up to 3.0 mass % and the balance being Fe except inevitable impurities, under the condition that a value $Md_{30}$ representing a ratio of a strain-induced martensite phase defined by the under-mentioned formula is within a range of −60 to −15.2:

$$Md_{30}=551-462(C+N)-9.2Si-29(Ni+Cu)-8.1Mn-13.7Cr-18.5Mo;$$

and wherein a blanked sheet of said austenitic stainless steel will have a shear plane ratio of 100%.

2. The austenitic stainless steel according to claim 1, wherein the austenitic stainless steel achieves a 20–150% ratio increase of Vickers hardness by cold-rolling after annealing and pickling, the ratio calculated by {(Vickers hardness of a cold-rolled steel sheet)−(Vickers hardness of an annealed steel sheet)}/(Vickers Hardness of an annealed steel sheet)×100(%).

3. The austenitic stainless steel according to claim 1, wherein the austenitic stainless steel has a grain size number of #8 to #11.

4. The austenitic stainless steel according to claim 1, wherein the C content is 0.010–0.030 mass %.

* * * * *